US007891750B2

(12) United States Patent
Iriguchi

(10) Patent No.: US 7,891,750 B2
(45) **Date of Patent: *Feb. 22, 2011**

(54) INK-DROPLET EJECTING APPARATUS

(75) Inventor: Akira Iriguchi, Ichinomiya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 844 days.

This patent is subject to a terminal disclaimer.

(21) Appl. No.: 11/698,385

(22) Filed: Jan. 26, 2007

(65) Prior Publication Data

US 2007/0182774 A1 Aug. 9, 2007

(30) Foreign Application Priority Data

Jan. 27, 2006 (JP) ..... 2006-018742

(51) Int. Cl.
*B41J 29/38* (2006.01)

(52) U.S. Cl. ..... 347/11; 347/5; 347/10

(58) Field of Classification Search ..... 347/9–12
See application file for complete search history.

(56) References Cited

U.S. PATENT DOCUMENTS 6,099,103 A * 8/2000 Takahashi ..... 347/11
6,257,686 B1 7/2001 Takahashi et al.
6,386,665 B2 * 5/2002 Takahashi et al. ..... 347/10
6,412,896 B2 7/2002 Takahashi et al.
6,412,923 B1 7/2002 Takahashi
6,416,149 B2 7/2002 Takahashi et al.
6,595,628 B2 7/2003 Takagi et al.
7,600,838 B2 * 10/2009 Iriguchi ..... 347/10
2006/0250429 A1 11/2006 Sekiguchi

FOREIGN PATENT DOCUMENTS

JP 2001-18388 1/2001
JP 2001-301161 10/2001
JP 2002-254634 9/2002
JP 2006/0250429 11/2006

* cited by examiner

*Primary Examiner*—Geoffrey Mruk
(74) *Attorney, Agent, or Firm*—Frommer Lawrence & Haug LLP

(57) ABSTRACT

A driving pulse signal for forming one dot includes a first, a second, and a third main pulses applied intermittently with an intervals to eject an ink droplet, and a stabilizing pulse which is inserted between the main pulses, and which suppresses a residual vibration of an ink in a pressure chamber, generated by a main pulse applied previously. The third main pulse suppresses the residual vibration of the ink generated by the second main pulse, and also a pulse width of the third pulse is adjusted such that there is no residual vibration remained, due to application of the last main pulse. Consequently, it is possible to suppress effectively the residual vibration of the ink by the less number of the stabilizing pulses compared to the number of main pulses. As a result, an overall pulse width becomes short, and it is possible to increase the recording speed.

14 Claims, 9 Drawing Sheets

Fig. 4
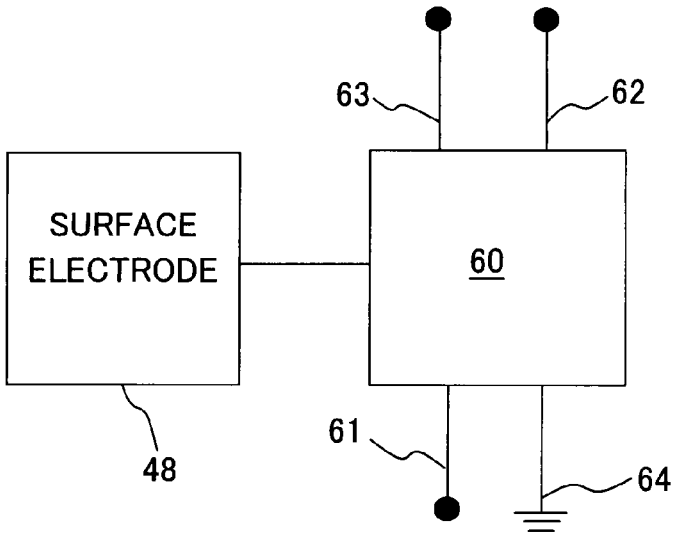
Fig. 5A
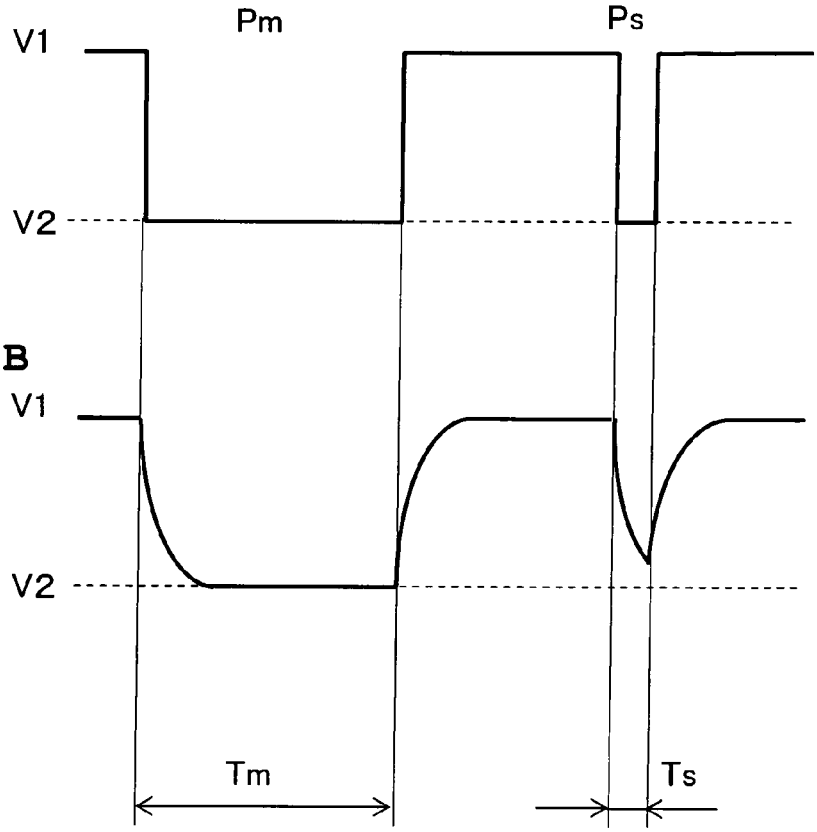
Fig. 5B

Fig. 7A

UNIT: μ sec

| | Tm1 | W1 | Ts1 | W2 | Tm2 | W3 | Tm3 | STABILITY |
|---|---|---|---|---|---|---|---|---|
| 1 | 2.2 | 5.8 | 1.1 | 5.0 | 2.5 | 4.0 | 3.0 | − |
| 2 | 2.8 | 5.8 | 1.1 | 5.0 | 2.5 | 4.0 | 3.0 | + |
| 3 | 3.4 | 5.8 | 1.1 | 5.0 | 2.5 | 4.0 | 3.0 | + |
| 4 | 3.9 | 5.8 | 1.1 | 5.0 | 2.5 | 4.0 | 3.0 | + |
| 5 | 4.5 | 5.8 | 1.1 | 5.0 | 2.5 | 4.0 | 3.0 | + |
| 6 | 5.2 | 5.8 | 1.1 | 5.0 | 2.5 | 4.0 | 3.0 | ± |
| 7 | 5.8 | 5.8 | 1.1 | 5.0 | 2.5 | 4.0 | 3.0 | − |
| 8 | 3.9 | 2.8 | 1.1 | 5.0 | 2.5 | 4.0 | 3.0 | − |
| 9 | 3.9 | 3.2 | 1.1 | 5.0 | 2.5 | 4.0 | 3.0 | ± |
| 10 | 3.9 | 3.6 | 1.1 | 5.0 | 2.5 | 4.0 | 3.0 | + |
| 11 | 3.9 | 4.2 | 1.1 | 5.0 | 2.5 | 4.0 | 3.0 | + |
| 12 | 3.9 | 5.8 | 1.1 | 5.0 | 2.5 | 4.0 | 3.0 | + |
| 13 | 3.9 | 6.8 | 1.1 | 5.0 | 2.5 | 4.0 | 3.0 | + |
| 14 | 3.9 | 8.4 | 1.1 | 5.0 | 2.5 | 4.0 | 3.0 | ± |
| 15 | 3.9 | 8.8 | 1.1 | 5.0 | 2.5 | 4.0 | 3.0 | ± |
| 16 | 3.9 | 9.2 | 1.1 | 5.0 | 2.5 | 4.0 | 3.0 | − |
| 17 | 3.9 | 5.8 | 0.4 | 5.0 | 2.5 | 4.0 | 3.0 | − |
| 18 | 3.9 | 5.8 | 0.6 | 5.0 | 2.5 | 4.0 | 3.0 | + |
| 19 | 3.9 | 5.8 | 1.1 | 5.0 | 2.5 | 4.0 | 3.0 | + |
| 20 | 3.9 | 5.8 | 1.4 | 5.0 | 2.5 | 4.0 | 3.0 | + |
| 21 | 3.9 | 5.8 | 1.6 | 5.0 | 2.5 | 4.0 | 3.0 | ± |
| 22 | 3.9 | 5.8 | 2.0 | 5.0 | 2.5 | 4.0 | 3.0 | − |
| 23 | 3.9 | 5.8 | 2.4 | 5.0 | 2.5 | 4.0 | 3.0 | − |
| 24 | 3.9 | 5.8 | 1.1 | 2.8 | 2.5 | 4.0 | 3.0 | − |
| 25 | 3.9 | 5.8 | 1.1 | 3.2 | 2.5 | 4.0 | 3.0 | ± |
| 26 | 3.9 | 5.8 | 1.1 | 3.6 | 2.5 | 4.0 | 3.0 | + |
| 27 | 3.9 | 5.8 | 1.1 | 4.4 | 2.5 | 4.0 | 3.0 | + |
| 28 | 3.9 | 5.8 | 1.1 | 5.0 | 2.5 | 4.0 | 3.0 | + |
| 29 | 3.9 | 5.8 | 1.1 | 5.8 | 2.5 | 4.0 | 3.0 | + |
| 30 | 3.9 | 5.8 | 1.1 | 6.6 | 2.5 | 4.0 | 3.0 | ± |
| 31 | 3.9 | 5.8 | 1.1 | 7.2 | 2.5 | 4.0 | 3.0 | ± |
| 32 | 3.9 | 5.8 | 1.1 | 7.4 | 2.5 | 4.0 | 3.0 | − |

Fig. 7B

UNIT: μ sec

| | Tm1 | W1 | Ts1 | W2 | Tm2 | W3 | Tm3 | STABILITY |
|---|---|---|---|---|---|---|---|---|
| 33 | 3.9 | 5.8 | 1.1 | 5.0 | 1.4 | 4.0 | 3.0 | − |
| 34 | 3.9 | 5.8 | 1.1 | 5.0 | 1.6 | 4.0 | 3.0 | ± |
| 35 | 3.9 | 5.8 | 1.1 | 5.0 | 2.0 | 4.0 | 3.0 | + |
| 36 | 3.9 | 5.8 | 1.1 | 5.0 | 2.8 | 4.0 | 3.0 | + |
| 37 | 3.9 | 5.8 | 1.1 | 5.0 | 3.2 | 4.0 | 3.0 | + |
| 38 | 3.9 | 5.8 | 1.1 | 5.0 | 3.6 | 4.0 | 3.0 | − |
| 39 | 3.9 | 5.8 | 1.1 | 5.0 | 4.0 | 4.0 | 3.0 | − |
| 40 | 3.9 | 5.8 | 1.1 | 5.0 | 2.5 | 3.0 | 3.0 | − |
| 41 | 3.9 | 5.8 | 1.1 | 5.0 | 2.5 | 3.2 | 3.0 | ± |
| 42 | 3.9 | 5.8 | 1.1 | 5.0 | 2.5 | 3.8 | 3.0 | + |
| 43 | 3.9 | 5.8 | 1.1 | 5.0 | 2.5 | 4.0 | 3.0 | + |
| 44 | 3.9 | 5.8 | 1.1 | 5.0 | 2.5 | 4.8 | 3.0 | + |
| 45 | 3.9 | 5.8 | 1.1 | 5.0 | 2.5 | 5.6 | 3.0 | ± |
| 46 | 3.9 | 5.8 | 1.1 | 5.0 | 2.5 | 5.8 | 3.0 | − |
| 47 | 3.9 | 5.8 | 1.1 | 5.0 | 2.5 | 4.0 | 1.8 | − |
| 48 | 3.9 | 5.8 | 1.1 | 5.0 | 2.5 | 4.0 | 2.0 | ± |
| 49 | 3.9 | 5.8 | 1.1 | 5.0 | 2.5 | 4.0 | 2.4 | + |
| 50 | 3.9 | 5.8 | 1.1 | 5.0 | 2.5 | 4.0 | 3.0 | + |
| 51 | 3.9 | 5.8 | 1.1 | 5.0 | 2.5 | 4.0 | 3.4 | + |
| 52 | 3.9 | 5.8 | 1.1 | 5.0 | 2.5 | 4.0 | 4.0 | ± |
| 53 | 3.9 | 5.8 | 1.1 | 5.0 | 2.5 | 4.0 | 4.2 | − |

Fig. 8

UNIT: μ sec

| | Tm1 | W1 | Ts1 | W2 | Tm2 | W3 | Tm3 |
|---|---|---|---|---|---|---|---|
| A | 4.0 | 4.0 | 1.4 | 6.0 | 2.5 | 4.0 | 3.0 |
| B | 3.6 | 5.0 | 1.0 | 5.0 | 2.0 | 4.4 | 2.6 |
| C | 4.2 | 6.0 | 0.8 | 4.0 | 2.5 | 4.0 | 3.0 |
| D | 4.0 | 6.0 | 1.2 | 5.0 | 3.0 | 3.8 | 3.2 |
| E | 3.8 | 8.0 | 1.0 | 5.0 | 2.5 | 4.0 | 3.0 |
| F | 3.8 | 4.2 | 7.0 | 3.8 | 3.0 | 5.3 | 3.5 |
| G | 4.5 | 5.0 | 7.0 | 4.5 | 2.0 | 4.5 | 3.2 |
| H | 5.0 | 5.0 | 7.5 | 4.5 | 3.5 | 4.5 | 3.5 |
| I | 4.5 | 4.0 | 7.0 | 3.5 | 3.0 | 5.5 | 3.0 |

INK-DROPLET EJECTING APPARATUS

CROSS REFERENCE TO RELATED APPLICATION

The present application claims priority from Japanese Patent Application No. 2006-018742, filed on Jan. 27, 2006, the disclosure of which are incorporated herein by reference in its entirety.

BACKGROUND OF THE INVENTION

1. Field of the Invention

The present invention relates to an ink-droplet ejecting apparatus of an ink-jet type.

2. Description of the Related Art

In hitherto known ink-jet printers, which are ink-droplet ejecting apparatuses, an ink-jet head is used which ejects an ink droplet from a nozzle by changing a volume of a pressure chamber in which an ink is filled, by displacing an electro-mechanical transducer (transducer element) such as a piezo-electric element by applying a driving pulse signal.

In the above mentioned ink-jet head, a gradation control in which, a dot diameter is changed is carried out. For forming one dot by a plurality of ink droplets, the driving pulse signal is set such that a plurality of pulses is applied continuously. Moreover, for suppressing an effect on a subsequent ejection of a vibration which is remained (residual vibration) in the ink after the ink droplets are ejected, a stabilizing pulse (canceling pulse) is output after a main pulse for ejecting the ink. For example, an ink jetting apparatus described in U.S. Pat. No. 6,412,923 (corresponds to Japanese Patent Application Laid-open No. 2001-18388), for forming one dot, outputs one after another, an ejecting pulse for a first droplet (a first-droplet ejecting pulse), an ejecting pulse for a second droplet (a second-droplet ejecting pulse), a stabilizing pulse, an ejecting pulse for a third droplet (a third-droplet ejecting pulse), an ejecting pulse for a fourth droplet (a fourth-droplet ejecting pulse), and another stabilizing pulse, and drives these pulses as one set.

Incidentally, in recent years, speed up of a recording speed (high-speed recording) in the ink-jet printers has been sought. For speed up the recording speed, it is necessary to increase a drive frequency, or in other words, to shorten a driving cycle for forming one dot. When the stabilizing pulse is output not only in between the plurality of ejecting pulses, but also at an end as in the ink jetting apparatus described in U.S. Pat. No. 6,412,923, an overall pulse width (width of all pulses) made of a plurality of pulse signals becomes long. As a result, the driving cycle becomes long, and it is not possible to increase the recording speed.

SUMMARY OF THE INVENTION

An object of the present invention is to realize an ink-droplet ejecting apparatus which is an ink ejecting apparatus ejecting a plurality of ink droplets for one dot, and which is capable of increasing the drive frequency by making short (shortening) the entire pulse width, and increase the recording speed. It should be noted that parenthesized reference numerals assigned to elements shown below are only examples of the elements, and are not intended to limit the elements.

According to a first aspect of the present invention, there is provided an ink-droplet ejecting apparatus (101) which ejects a plurality of ink droplets of an ink to form one dot onto a recording medium (P), including a pressure chamber (36) in which the ink is filled and a piezoelectric actuator (2) which faces the pressure chamber (36), and which changes a volume of the pressure chamber (36) according to a driving pulse signal for ejecting the ink droplets to form one dot, wherein the driving pulse signal includes a plurality of main pulses (Pm) which are successive with intervals to eject the ink droplets, and a stabilizing pulse (Ps) which is inserted between the main pulses (Pm), and which suppresses a residual vibration of the ink, in the pressure chamber (36), generated by one of the main pulse (Pm) applied before the stabilizing pulse, and a last main pulse, among the main pulses, is adjusted to suppress the residual vibration of the ink in the pressure chamber (36), generated by a main pulse applied before the last main pulse, and to prevent vibration generated by the last main pulse from remaining.

In order to shorten a driving cycle for forming one dot, it is necessary to shorten an one-way propagation time (a time in which a pressure wave generated due to a displacement of the piezoelectric actuator (2) is propagated in one way through an ink channel) with respect to a pulse width of each of a plurality of pulse signals. As a method for shortening the one-way propagation time, it is possible to shorten ink channels including the pressure chamber (36). However, in this case, since a length of the pressure chamber (36) which is affected by the displacement of the piezoelectric actuator (2) becomes short, it is necessary to increase a driving voltage applied to the piezoelectric actuator (2) to impart the same ejecting pressure. However, there are limitations on increasing the driving voltage. On the other hand, in the ink-droplet ejecting apparatus (101) of the present invention, at the time of forming one dot, a plurality of ink droplets is ejected by the plurality of main pulses (Pm), and by inserting the stabilizing pulse (Ps) between the main pulses (Pm), the residual vibration of the ink is suppressed. Furthermore, since the last main pulse among the plurality of main pulses (Pm) suppresses the residual vibration of the ink in the pressure chamber generated by the main pulses which were applied before the last main pulse, and has the pulse width such that no vibration by the last main pulse is remained, it is possible to suppress effectively the residual vibration of the ink by less number of the stabilizing pulses (Ps) as compared to the number of the main pulses (Pm). As a result, it is possible to shorten an overall pulse width, and to drive with a short cycle, thereby enabling to increase the recording speed. Furthermore, since it is not necessary to shorten the ink channel to shorten the driving cycle, it is not necessary to shorten a length of the pressure chamber (36). Consequently, it is not necessary to increase a driving voltage to impart the same ejecting pressure.

In the ink-droplet ejecting apparatus (101) of the present invention, the main pulses (Pm) may include a first main pulse (Pm1), a second main pulse (Pm2), and a third main pulse (Pm3), and the stabilizing pulse (Ps) may be inserted between the first main pulse (Pm1) and the second main pulse (Pm2). In this case, by inserting the stabilizing pulse (Ps) between the first main pulse (Pm1) and the second main pulse (Pm2), it is possible to suppress effectively the residual vibration of the ink, and to shorten the overall pulse width.

In the ink-droplet ejecting apparatus (101) of the present invention, the second main pulse (Pm2) and the third main pulse (Pm3) may have a short pulse width with respect to an one-way propagation time AL of a pressure wave generated due to the change in the volume of the pressure chamber (36). In this case, it is possible to suppress effectively the residual vibration in the ink after ejecting a plurality of ink droplets, and to shorten the overall pulse width.

In the ink-droplet ejecting apparatus (101) of the present invention, a pulse width Ts1 of the stabilizing pulse with respect to an one-way propagation time AL of a pressure wave generated due to the change in the volume of the pressure chamber (36) may be 0.15 AL≦Ts1≦0.40 AL. In this case, it is possible to suppress effectively the residual vibration in the ink during the ejection, and to suppress the residual vibration after ejection of a plurality of droplets early.

In the ink-droplet ejecting apparatus (101) of the present invention, each of the main pulses (Pm1, Pm2, and Pm3) may have a pulse width sufficiently large for a voltage applied to the actuator (2) to change from a voltage of one of two predetermined voltages, to be the other voltage of the two predetermined voltages, and the stabilizing pulse (Ps) may have a pulse width which is insufficient for the voltage to change from the one of the two predetermined voltages, to be the other voltage of the two predetermined voltages. In this case, by applying the stabilizing pulse (Ps) immediately after the main pulse (Pm) which is immediately before the stabilizing pulse, it is possible to suppress effectively in a short time the residual vibration of the ink during the ejection. Moreover, it is possible to form favorably one dot by the previous main pulses and the subsequent main pulses.

In the ink-droplet ejecting apparatus (101) of the present invention, a pulse width Tm1 of the first main pulse (Pm1), a pulse width Ts1 of the stabilizing pulse (Ps), a pulse width Tm2 of the second main pulse (Pm2), a pulse width Tm3 of the third main pulse (Pm3), an interval W1 between a tail end of the first main pulse (Pm1) and a lead end of the stabilizing pulse (Ps), an interval W2 between a tail end of the stabilizing pulse (Ps) and a lead end of the second main pulse (Pm2), an interval W3 between a tail end of the second main pulse (Pm2) and a lead end of the third main pulse (Pm3) may satisfy following relationships with respect to an one-way propagation time AL of a pressure wave generated due to the change in the volume of the pressure chamber (36): 0.7 AL≦Tm1≦1.3 AL, 0.8 AL ≦W1≦2.2 AL, 0.15 AL≦Ts1≦0.4 AL, 0.8 AL≦W2≦1.8 AL, 0.4 AL≦Tm2≦0.8 AL, 0.8 AL≦W3≦1.4 AL, and 0.5 AL≦Tm3≦1.0 AL. Furthermore, the Tm1, the Ts1, the Tm2, the Tm3, the W1, the W2, and the W3 may satisfy following relationships: 0.9 AL ≦Tm1≦1.05 AL, 1.0 AL≦W1≦2.0 AL, 0.2 AL≦Ts1≦0.35 AL, 1.0 AL≦W2≦1.5 AL, 0.5 AL≦Tm2≦0.75 AL, 0.95 AL≦W3≦1.1 AL, and 0.65 AL≦Tm3≦0.8 AL. In these cases, it is possible to suppress effectively the residual vibration of the ink, and to shorten the overall pulse width. Consequently, it is possible to drive with a short cycle, and to increase the recording speed.

In the ink-droplet ejecting apparatus (101) of the present invention, a pulse width Ts1 of the stabilizing pulse (Ps) with respect to an one-way propagation time AL of a pressure wave generated by the change in the volume of the pressure chamber (36) may be 1.7 AL≦Ts1≦1.8 AL. In this case, it is possible to suppress effectively the residual vibration of the ink during the ejection, and to suppress the residual vibration after a plurality of droplets is ejected early.

In the ink-droplet ejecting apparatus (101) of the present invention, a pulse width Tm1 of the first main pulse (Pm1), a pulse width of Ts1 of the stabilizing pulse (Ps), a pulse width Tm2 of the second main pulse (Pm2), a pulse width Tm3 of the third main pulse (Pm3), an interval W1 between a tail end of the first main pulse (Pm1) and a lead end of the stabilizing pulse (Ps), an interval W2 between a tail end of the stabilizing pulse (Ps) and a lead end of the second main pulse (Pm2), and an interval W3 between a tail end of the second main pulse (Pm2) and a lead end of the third main pulse (Pm3) satisfy following relationships with respect to an one-way propagation time AL of a pressure wave generated due to the change in the volume of the pressure chamber (36): 0.95≦Tm1 ≦1.25 AL, 1.0 AL≦W1≦1.25 AL, 1.7 AL≦Ts1≦1.88 AL, 0.87 AL≦W2≦1.13 AL, 0.5 AL≦Tm2≦0.88 AL, 1.12 AL≦W3≦1.38 AL, and 0.75 AL≦Tm3≦0.88 AL. In this case, it is possible to suppress effectively the residual vibration of the ink, and to shorten the overall pulse width. Consequently, it is possible to drive with a short cycle, and to increase the recording speed.

In the ink-droplet ejecting apparatus (101) of the present invention, the volume of the pressure chamber (36) may be increased at lead ends of the stabilizing pulse (Ps) and the main pulses applied to the actuator (2), and may be decreased at tail ends of the stabilizing pulse (Ps) and the main pulses (Pm) applied to the actuator (2).

In the ink-droplet ejecting apparatus (101) of the present invention, the actuator (2) may be a piezoelectric element which is displaced with respect to the pressure chamber (36), by application of a voltage.

In the ink-droplet ejecting apparatus (101) of the present invention, the actuator (2) may further include a surface electrode (48) to which the driving pulse signal is applied.

The ink-droplet ejecting apparatus (101) of the present invention may further include a signal control unit (200) which supplies the driving pulse signal to the surface electrode (48).

In the ink-droplet ejecting apparatus (101) of the present invention, the signal control unit (200) may adjust a pulse width of the stabilizing pulse (Ps) such that the ink droplets are not ejected.

In the ink-droplet ejecting apparatus (101) of the present invention, the signal control unit (200) may adjust a pulse width of the stabilizing pulse (Ps) to be shorter than a pulse width of each of the main pulses (Pm).

BRIEF DESCRIPTION OF THE DRAWINGS

FIG. 4 is a block diagram of a control unit;

FIG. 5A is a schematic diagram showing a relationship between a pulse and a voltage in a driving pulse signal;

FIG. 5B is a schematic diagram showing a practical relationship between the pulse and the voltage in the driving pulse signal;

FIG. 7A is a table showing experiment results of the driving pulse signal;

FIG. 7B is a table showing a continuation of the experiment results shown in FIG. 7A;

FIG. 8 is a table showing other experiment results of the driving pulse signal.

DETAILED DESCRIPTION OF THE PREFERRED EMBODIMENTS

A basic embodiment of the present invention will be described below by referring to FIG. 1 to FIG. 9.

Figure 9:
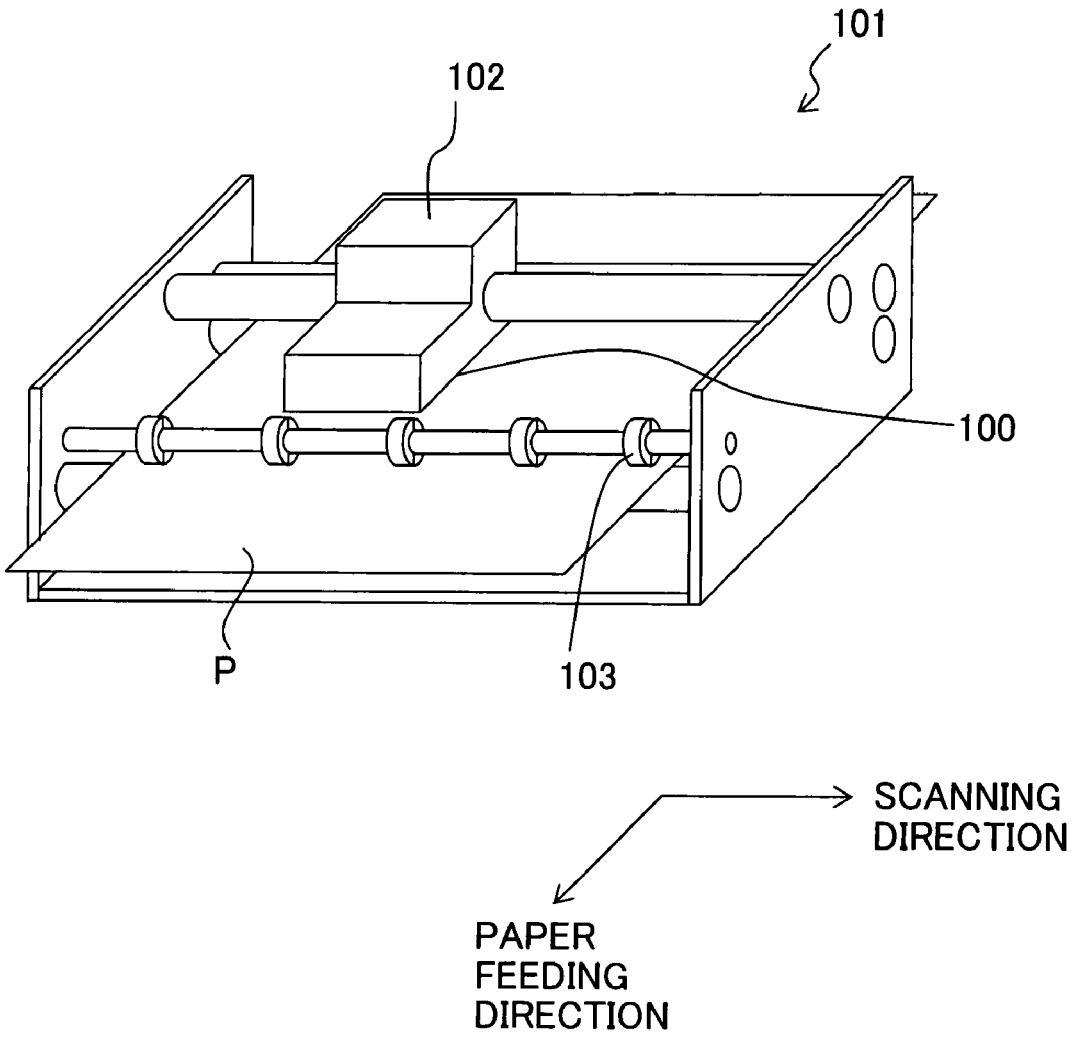
FIG. 9 is a schematic perspective view of the ink-droplet ejecting apparatus of the present invention.

As shown in FIG. 9, an ink-droplet ejecting apparatus 101 includes a carriage 102 which is movable in a scanning direction (left and right direction in FIG. 9), an ink-jet head 100 which is movable along with the carriage 102, and which jets an ink onto a recording paper P, paper transporting rollers 103 which transport the recording paper P in a paper feeding direction (paper-surface frontward direction in FIG. 9), and the like. Moreover, the ink-jet head 100, while moving integrally with the carriage 102 in the scanning direction, performs printing on the recording paper P from nozzles 4 arranged on a lower surface thereof (refer to FIG. 3). The recording paper P with the printing performed thereon by the ink-jet head 100 is discharged in the paper feeding direction by the paper transporting rollers 103.

Figure 1:
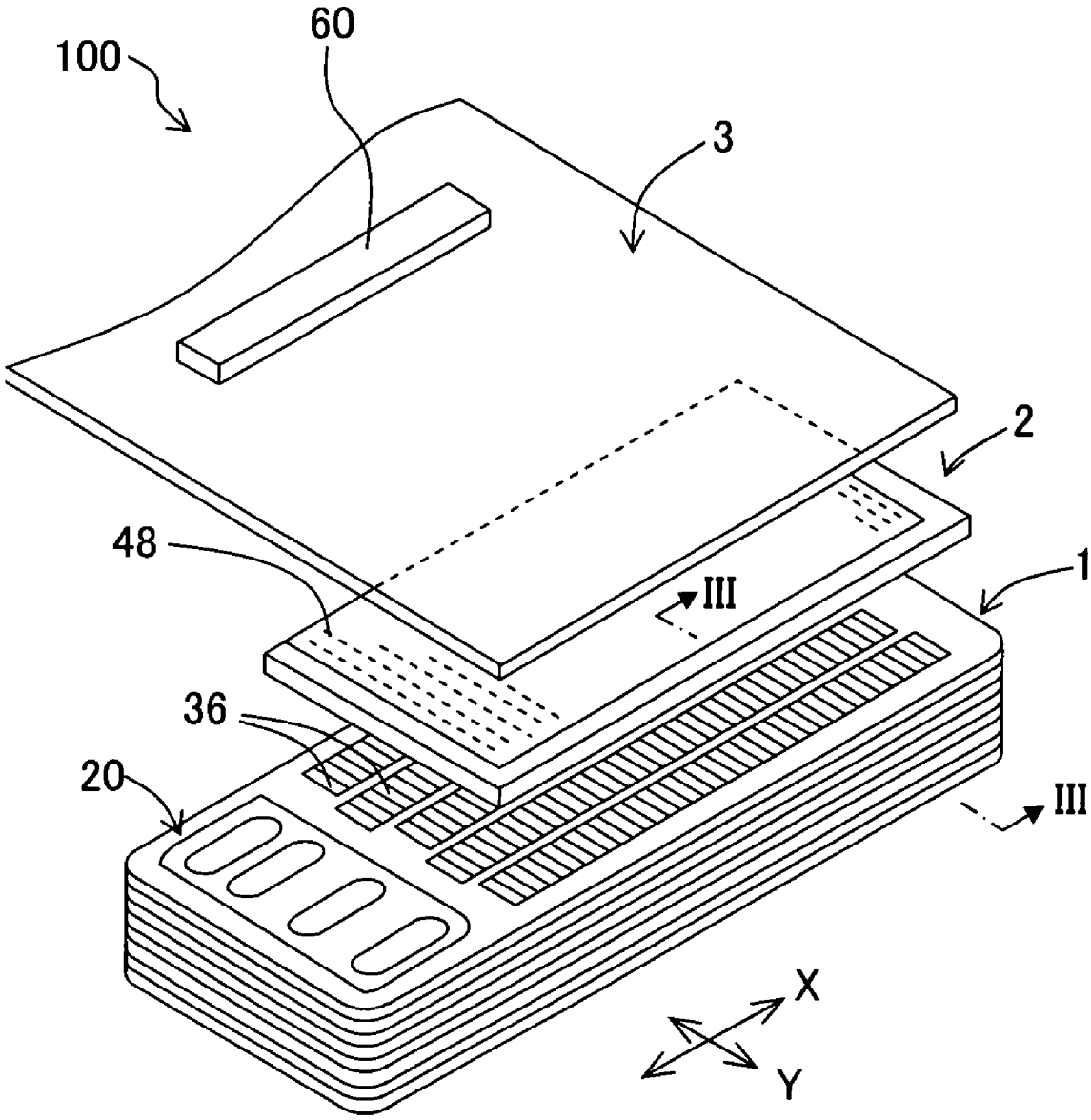
FIG. 1 is a perspective view of an ink-jet head used in an ink-droplet ejecting apparatus of the present invention.

Next, the ink-jet head 100 will be described below. As shown in FIG. 1, in the ink-jet head 100 of the present invention, a plate-type piezoelectric actuator 2 is joined to a cavity unit 1 which includes a plurality of plates. A flexible flat cable 3 which connects with a control unit is joined to an upper surface of the plate-type piezoelectric actuator 2. The ink is ejected in a downward direction in FIG. 3 from nozzles 4 opening on a lower surface of the cavity unit 1 (refer to FIG. 3).

Figure 2:
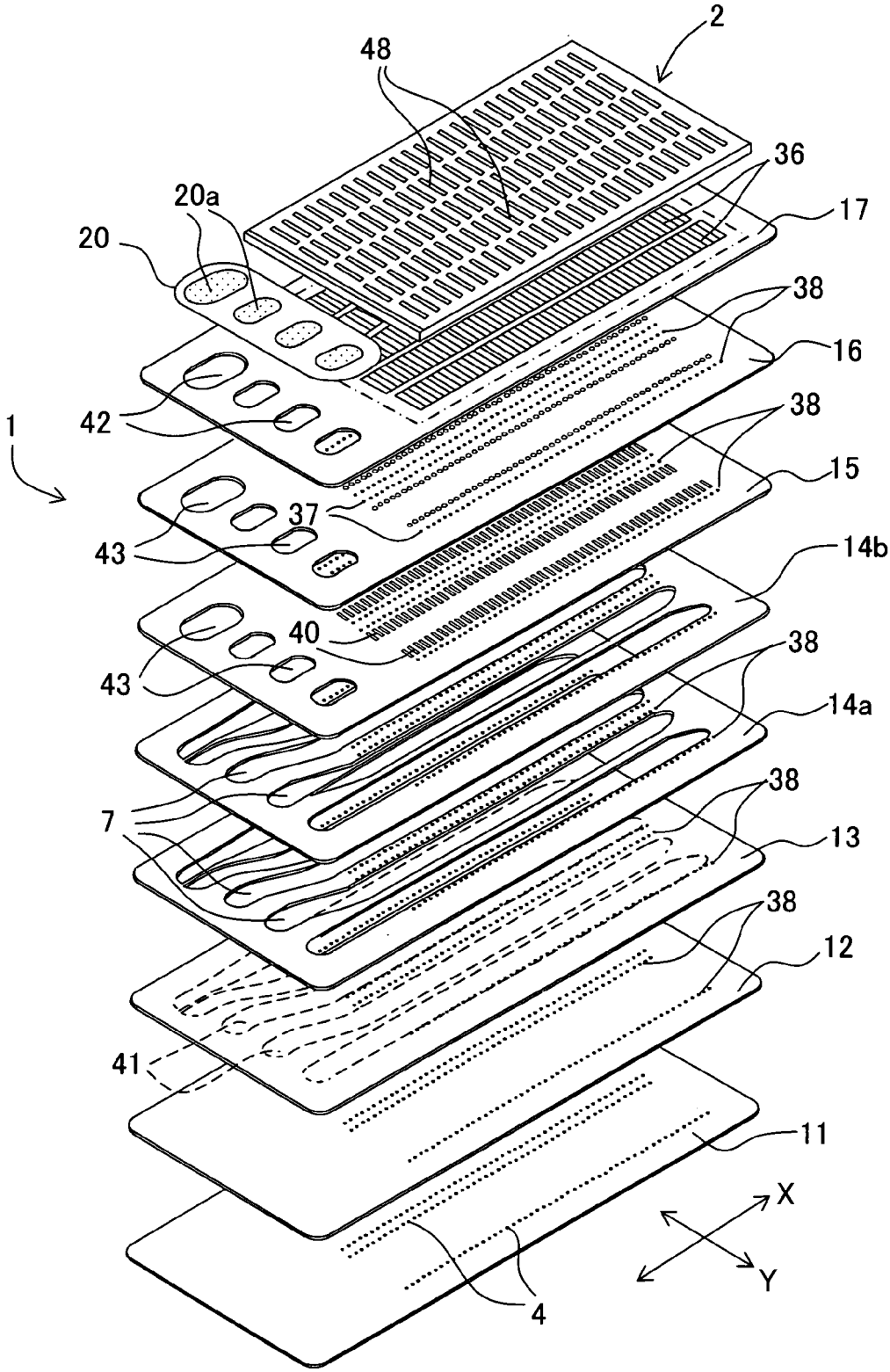
FIG. 2 is an exploded perspective view of the ink-jet head.

The cavity unit 1, as shown in FIG. 2, includes totally eight thin and flat plates namely a nozzle plate 11, a spacer plate 12, a damper plate 13, two manifold plates 14*a* and 14*b*, a supply plate 15, a base plate 16, and a cavity plate 17, and has a structure in which these plates are stacked in layers to face the surfaces mutually. The plates are mutually joined by adhesive.

Each of the plates 11 to 17 has a thickness of about 40 μm to 150 μm. The nozzle plate 11 is made of a synthetic resin (material) such as polyimide, and the other plates 12 to 17 are made of 42% nickel alloy steel plate. The nozzles 4 having a substantially small diameter (of about 20 μm) are formed and arranged at substantially small (short) intervals in the nozzle plate 11. The nozzles 4 are arranged in five rows along a longitudinal direction (X direction) of the nozzle plate 11.

Figure 3:
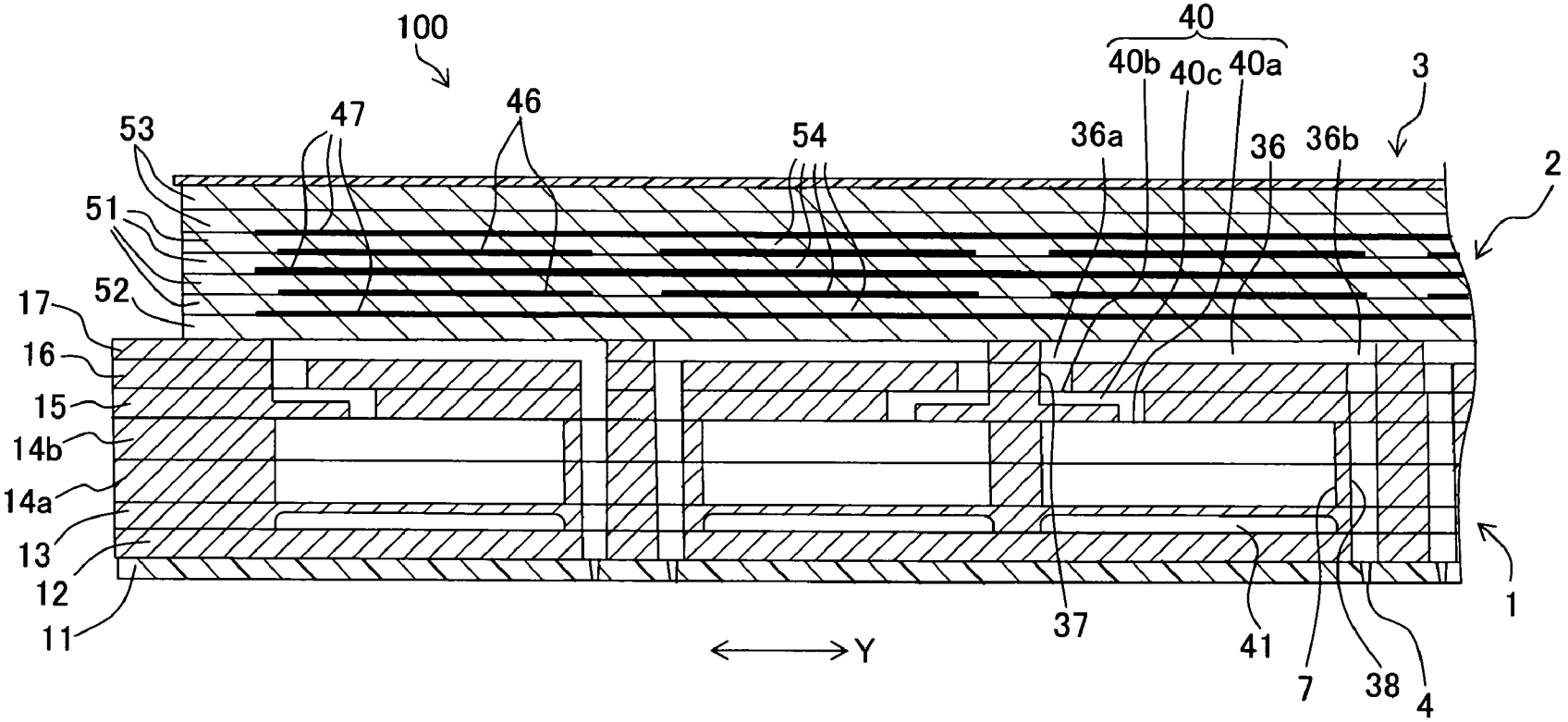
FIG. 3 is a cross-sectional view taken a long a line III-III in FIG. 1.

Each of the nozzles 4, as shown in FIG. 3, is connected to a pressure chamber 36 in the cavity plate 17, via a through channel 38 which is formed through the spacer plate 12, the damper plate 13, the two manifold plates 14*a* and 14*b*, the supply plate 15, and the base plate 16.

In the cavity plate 17, the pressure chamber 36 is provided as a plurality of pressure chambers and arranged in five rows parallel to a longitudinal direction (X direction) of the cavity plate 17 as shown in FIG. 2. Each of the pressure chambers 36 has a long and slender shape in a plan view, and is drilled through the cavity plate 17 such that a longitudinal direction of the pressure chamber 36 is along a short side direction (Y direction) of the cavity plate 17. Each of the pressure chambers 36 is formed to be long and slender in shape, such that a longer side is along a direction of flow of ink. As shown in FIG. 3, one end 36*a* in the longitudinal direction of each of the pressure chambers 36 communicates with a common ink chamber 7 via a connecting channel 40 and a communicating hole 37 which will be described later, and the through channel 38 is connected to the other end 36*b* of the pressure chamber 36.

The connecting channel 40 which supplies the ink from the common ink chamber 7 to the pressure chamber 36 is provided as a plurality of the connecting channels 40 to the supply plate 15 which is adjacent to a lower surface of the cavity plate 17 via the base plate 16. Each of the connecting channels 40, as shown in FIG. 3, is provided with an inlet port 40*a* through which the ink enters (flows in) from the common ink chamber 7, an outlet port 40*b* which is connected to the pressure chamber 36 via the communicating hole 37 of the base plate 16, and an aperture 40*c* which is positioned between the inlet port 40*a* and the outlet port 40*b*, and which is formed to make a cross-sectional area small such that a channel resistance is the maximum among the connecting channel 40. This aperture 40*c* is provided for preventing a back flow of the ink to the common ink chamber 7, and for allowing the ink to advance efficiently toward one of the nozzles 4, when an ejecting pressure for ejecting the ink from the nozzle 4 is exerted on the pressure chamber 36.

In the two manifold plates 14*a* and 14*b*, the common ink chamber 7 is provided as five common ink chambers 7, which are long along a longitudinal direction (X direction) of the two manifold plates 14*a* and 14*b* formed through the plates 14*a* and 14*b*, to extend along each of the rows of the nozzles 4. In other words, the two manifold plates 14*a* and 14*b* are stacked, and an upper surface of the stacked manifold plates 14*a* and 14*b* is covered by the supply plate 15 and a lower surface thereof is covered by the damper plate 13, thereby forming a total of five common ink chambers (manifold chambers) 7. Each of the common ink chambers 7, in a plan view from a direction of stacking of each plate, extends to be long in a direction of rows of the pressure chambers 36 (direction of the rows of the nozzles 4) overlapping with a part of each of the pressure chambers 36.

As shown in FIG. 2 and FIG. 3, on a lower surface side of the damper plate 13 adjacent to a lower surface of the manifold plate 14*a*, a plurality of damper chambers 41 completely isolated from the common ink chambers 7 is formed as recesses. A position and a shape of each of the damper chambers 41 coincide with those of each of the common ink chambers 7 as shown in FIG. 2. A ceiling in the form of a thin plate of the damper plate 13, on an upper side of the damper chamber 41 is capable of free elastic vibrations both toward the common ink chambers 7 and toward the damper chambers 41. At the time of ejection of the ink, even when a pressure fluctuation generated in the ink in the pressure chamber 36 is propagated to one of the common ink chamber 7, since the ceiling is deformed elastically, a damper effect of absorbing and attenuating the pressure fluctuation is shown. Accordingly, it is possible to suppress a cross-talk which is a phenomenon in which the pressure fluctuation in one pressure chamber 36 is propagated to the other pressure chamber 36.

Moreover, as shown in FIG. 2, on an end portion on one short side of the cavity plate 17, four ink supply ports 42 are formed as ink-inlets to the cavity unit 1. Four connecting ports 43 are formed in each of the base plate 16 and the supply plate 15, corresponding to the four ink supply ports 42 vertically. The ink from an ink supply source flows into one end portion in the longitudinal direction of each of the common ink chambers 7 via the ink supply ports 42 and the connecting ports 43. A filter 20 having filter portions 20*a* corresponding to openings of the ink supply ports is adhered to the four ink supply ports 42 by an adhesive, or the like.

In this embodiment, four ink supply ports 42 and four connecting ports 43 are provided, and on the other hand, five common ink chambers 7 are provided. Only the leftmost ink supply port 42 in FIG. 2 among the ink supply ports 42 is provided to supply the ink to two common ink chambers 7. Since a frequency of use of a black ink is higher as compared to other color inks, the black ink is supplied to this ink supply port 42. Inks of yellow, magenta, and cyan colors are supplied separately to the other ink supply ports 42.

The piezoelectric actuator 2 has a structure similar to a structure of a hitherto known actuator disclosed in U.S. Pat. No. 6,595,628 (corresponds to Japanese Patent Application Laid-open No. 2002-254634). More specifically, a plurality of flat ceramics layers each having a size to cover all the pressure chambers 36 is stacked in a direction orthogonal to the flat direction, and individual electrodes 46 and common electrodes 47 are sandwiched alternately between the flat ceramics layers. The ceramics layers include a plurality of base piezoelectric layers 51 formed as active portions 54, in which a portion of each of the ceramics layers sandwiched between the individual electrodes 46 and the common electrodes 47 is polarized in a facing direction of both of the electrodes, top layer 53 on an upper surface of the base piezoelectric layers 51, and a bottom layer 52 on a lower surface of the base piezoelectric layers 51. A lower surface of the bottom layer 52 is adhered to the cavity plate 17 by an adhesive. Each of the individual electrodes 46 is arranged to face one of the pressure chambers 36, and each of the common electrodes 47 is arranged to cover the pressure chambers 36. By applying a voltage between the individual electrodes 46 and the common electrodes 47, the ceramics layers sandwiched between the individual electrodes 46 and the common electrodes 47 are deformed in a direction in which volumes of the pressure chambers 36 change.

A surface electrode 48 (refer to FIG. 1) which is electrically connected to the individual electrodes 46 and the common electrodes 47 via an electroconductive material is formed on an upper surface of the top layer 53, and a flexible flat cable 3 is connected to the surface electrode 48.

A structure of a control unit (signal control unit) 200 which generates a driving pulse signal to be applied to each of the electrodes will be described by referring to FIG. 4. The control unit 200 includes a LSI (large scale integration) chip 60 (refer to FIG. 1) which is disposed on the flexible flat cable 3. The surface electrode 48 corresponding to each of the individual electrodes 46 and the common electrodes 47 is connected to the LSI chip 60. Moreover, a clock line 61, a data line 62, a voltage line 63, and an earth line 64 extending from a main-body circuit not shown in the diagram are connected to the LSI chip 60. On the data line 62, data corresponding to each of the nozzles 4 is supplied serially in synchronization with a clock pulse supplied from the clock line 61. A plurality of driving waveform data supplied from the main-body circuit via the voltage line 63 is output based on the data described above, and driving pulse signals of voltage suitable for driving the active portions 54 are generated. Accordingly, the driving pulse signals are applied to the surface electrode 48 corresponding to the desired pressure chambers 36.

Each of the driving pulse signals, as shown in FIG. 5A, is formed by a pulse which changes between voltages V1 and V2, and in this embodiment, V1 is set to be any positive voltage value (for example about 22 V) and V2 is set to 0 V. Before the ink is ejected, a positive voltage V1 is applied to all of the individual electrodes 46, and the common electrodes 47 are connected to ground. Consequently, the active portions 54 between the individual electrodes 46 and the common electrodes 47 are extended, and the volumes of all of the pressure chambers 36 are contracted. When a voltage application to one of the individual electrodes 46 corresponding to one of the pressure chambers 36 to eject the ink is stopped (switched to V2), the active portion 54 regains a contracted state, and the volume of the pressure chamber 36 is increased. As the volume of the pressure chamber 36 is increased, the ink in the pressure chamber 36 is subjected to a negative pressure, and a pressure wave is generated. When the voltage is applied again to the individual electrode 46 at a timing when the pressure of the pressure wave is changed to a positive pressure, a pressure due to the extension of the active portion 54, and the pressure changed to the positive pressure are superimposed, and an ink droplet is ejected from the nozzle 4.

The pulse, as it has been described above, changes between the voltage V1 and V2 set in advance. However, in practice, as shown in FIG. 5B, a rise and a fall of the waveform delay. This is because the piezoelectric layer sandwiched between the individual electrode 46 and the common electrode 47 acts as a condenser (C), and this is because there is a resistance (R) in a path from the control unit 200, which outputs the driving pulse signal, up to the individual electrode 46. In other words, even when the control unit 200 outputs a rectangular wave as a driving pulse signal, since an integrating circuit is formed by the C and R, the rise and the fall of the pulse delay in the individual electrode 46. Therefore, by setting a pulse Pm to have a sufficient pulse width Tm including the delay, it is possible to make the voltage (to be) applied to the piezoelectric actuator 2 to change from the voltage V1 to the voltage V2. On the other hand, by setting a pulse Ps to have a short pulse width Ts, the voltage (to be) applied to the piezoelectric actuator 2 does not change from the voltage V1 to the voltage V2. In other words, it is possible to make a change in the voltage (to be) applied to the piezoelectric actuator 2 to be a low voltage difference.

However, contrary to the description above, as in the actuator disclosed in U.S. Pat. Nos. 6,257,686, 6,386,665, 6,412,896, and 6,416,149 (correspond to Japanese Patent Application Laid-open No. 2001-301161), the piezoelectric actuator of the present invention may be formed such that the volumes of the pressure chambers are increased by applying a voltage to driving electrodes, thereby generating a pressure wave, and by stopping applying the voltage at a point of time at which the pressure wave has reversed, the volumes of the pressure chambers are decreased, thereby ejecting the ink droplets.

In this ink-droplet ejecting apparatus, in order to carry out a gradational expression, in which a diameter (an area) of a dot formed on a recording medium is changed, a plurality of driving waveform data signals are set in advance such that volume of ink ejected to form one dot can be changed. In a case of controlling the dot diameter, the number of pulses for ejecting ink droplets is increased or decreased, as it has been known. As an example, a driving waveform for ejecting a plurality of ink droplets at the time of forming one dot is shown in FIG. 6.

Figure 6:
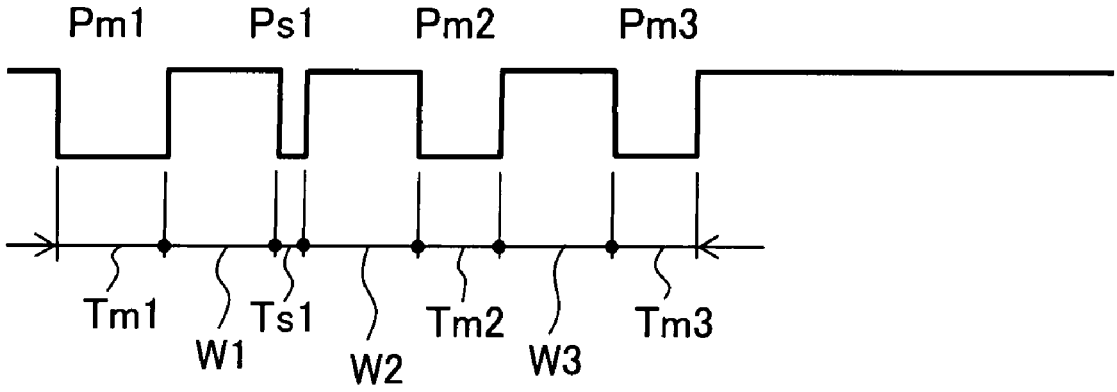
FIG. 6 is a schematic diagram showing the driving pulse signal.

In FIG. 6, the driving pulse signal is formed by four pulses including three main pulses, and these four pulses are applied in an order of a first main pulse Pm1, a stabilizing pulse Ps1, a second main pulse Pm2, and a third main pulse Pm3. Each pulse, as described in FIG. 5A and FIG. 5B, drives the piezoelectric actuator 2 to increase the volume of the pressure chambers 36 and then to decrease the volume of pressure chambers 36. In a driving pulse signal of this structure, firstly, an ink droplet is ejected by imparting a substantial pressure to the ink in the pressure chamber 36 by the first main pulse Pm1, and after ejecting the ink, a residual vibration of the ink in the pressure chamber is suppressed by the stabilizing pulse Ps1. Next, ink droplets are again ejected continuously by the second main pulse Pm2 and the third main pulse Pm3. The third main pulse Pm3, in addition to (performing) an ejection operation, also has a function to suppress the residual vibration of the ink in the pressure chamber generated due to the ejection. The stabilizing pulse Ps1 does not eject an ink droplet.

Results of experiments carried out by inventors of the present invention are shown in FIG. 7A and FIG. 7B. The inventors let a pulse width (time series) of the first main pulse Pm1, the stabilizing pulse Ps1, the second main pulse Ps2, and the third main pulse Ps3 to be Tm1, Ts1, Tm2, and Tm3 respectively, and an interval between a tail end of the first main pulse Pm1 and a lead end of the stabilizing pulse Ps1 to be W1, an interval between a tail end of the stabilizing pulse Ps1 and a lead end of the second main pulse Pm2 to be W2, and an interval between a tail end of the second main pulse Pm2 and a lead end of the third main pulse Pm3 to be W3, and carried out experiments by changing these values (unit: μsec).

At this time, a series of pulses in FIG. 6 was treated as one set, and this set was driven in a plurality of continuous cycles with a drive frequency of 26 KHz, and stability when the ink droplets were ejected continuously was analyzed.

In FIG. 7A and FIG. 7B, the "stability" is based on results of observation whether a splash or ink mist was generated in an ejecting state. A state of the highest stability, in which the residual vibration was sufficiently suppressed even when the inks were continuously ejected and there was no splash or ink mist, is indicated as "+". A state, in which the stability was declined compared to the highest stability but there was no practical problem, is indicated as "±". A state in which the stability was low and was not practical is indicated as "–".

It is possible to express the pulse width and the interval by using a time AL, which the pressure wave generated in the ink in the ink channel including the pressure chamber 36 is propagated one-way in a longitudinal direction in the ink channel (one-way propagation time of the pressure wave generated due to the change in the volume of the pressure chamber). In other words, AL means ½ of a cycle of the pressure fluctuation of the ink. In the ink-jet head 100 used in this experiment, AL is 4 μsec. Consequently, from the results of the experiments, it is possible to indicate appropriate practical ranges of the pulse widths and the intervals taken margins, or the like into consideration.

0.7 AL≦Tm1≦1.3 AL (2.8 μsec≦Tm1≦5.2 μsec), 0.8 AL≦W1≦2.2 AL (3.2 μsec≦W1≦8.8 μsec), 0.15 AL≦Ts1 ≦0.4 AL (0.6 μsec≦Ts1≦1.6 μsec), 0.8 AL≦W2≦1.8 AL (3.2 μsec≦W2≦7.2 μsec), 0.4 AL≦Tm2≦0.8 AL (1.6 μsec≦Tm2 ≦3.2 μsec), 0.8 AL≦W3≦1.4 AL (3.2 μsec≦W3≦5.6 μsec), 0.5 AL≦Tm3≦1.0 AL (2.0 μsec≦Tm3≦4.0 μsec). Each of the first main pulse Pm1, the second main pulse Pm2, and the third main pulse Pm3, similarly as the pulse Pm in FIG. 5B, has a time sufficient for making the voltage to be applied to the piezoelectric actuator 2 to change from the voltage V1 to the voltage V2. The stabilizing pulse Ps1, similarly as the pulse Ps in FIG. 5B, does not make the voltage to be applied to the piezoelectric actuator 2 to change from the voltage V1 to the voltage V2. In other words, the voltage to be applied to the piezoelectric actuator 2 is let to be a low voltage. When the stabilizing pulse Ps1 is in a range lower than 2 μsec, the voltage does not change completely from the voltage V1 to the voltage V2.

Moreover, it was revealed that even more preferable results are achieved with driving pulse signals shown in A to E in FIG. 8, by further experiments based on the experiment results shown in FIG. 7A and FIG. 7B. More optimum ranges shown below were derived, based on the results of A to E in FIG. 8, the margin, and the like. The ranges shown below are indicated by using the one-way propagation time AL.

0.9 AL≦Tm1 ≦1.05 AL (3.6 μsec≦Tm1≦4.2 μsec), 1.0 AL≦W1≦2.0 AL (4.0 μsec≦W1≦8.0 μsec), 0.2 AL≦Ts1 ≦0.35 AL (0.8 μsec≦Ts1≦1.4 μsec), 1.0 AL≦W2≦1.5 AL (4.0 μsec≦W2≦6.0 μsec), 0.5 AL≦Tm2≦0.75 AL (2.0 μsec≦Tm2 ≦3.0 μsec), 0.95 AL≦W3≦1.1 AL (3.8 μsec≦W3≦4.4 μsec), 0.65 AL≦Tm3≦0.8 AL (2.6 μsec≦Tm3≦3.2 μsec). Moreover, by repeating the experiments, it was revealed that favorable results are achieved even with driving pulse signals including stabilizing pulses Ps1 each having a comparatively longer pulse width, as shown in F to I in FIG. 8. Based on the results of F to I in FIG. 8, the margin, and the like, another optimum ranges different from the ranges described above were derived. The ranges shown below are indicated by using the one-way propagation time AL.

0.95 AL≦Tm1≦1.25 AL (3.8 μsec≦Tm1≦5.0 μsec), 1.0 AL≦W1≦1.25 AL (4.0 μsec≦W1≦5.0 μsec), 1.7 AL≦Ts1 ≦1.88 AL (6.8 μsec≦Ts1≦7.5 μsec), 0.87 AL≦W2≦1.13 AL (3.48 μsec≦W2≦4.5 μsec), 0.5 AL≦Tm2≦0.88 AL (2.0 μsec ≦Tm2≦3.5 μsec), 1.12 AL≦W3≦1.38 AL (4.48 μsec≦W3≦5.5 μsec), 0.75 AL≦Tm3≦0.88 AL (3.0 μsec≦Tm3≦3.5 μsec). In the driving pulse signal which has above described optimum ranges, each of the first main pulse Pm1, the second main pulse Pm2, and the third main pulse Pm3 is for ejecting an ink droplet by generating a substantial pressure wave in the ink. It was revealed that, among these main pulses, by setting the pulse width of the second main pulse Pm2 and the third main pulse Pm3 to be shorter with respect to the one-way propagation time AL, the second main pulse Pm2 and the third main pulse Pm3 also have a function of suppressing the residual vibration due to ejection. Moreover, the pulse width of the second main pulse Pm2 and the third main pulse Pm3 being short, it is possible to shorten a length of the entire driving pulse signal. Consequently, there is shown an effect that the driving cycle does not become long, while the driving pulse signal ejects a plurality of ink droplets.

The stabilizing pulse Ps1 is for suppressing the residual vibration of the ink by being applied in a phase which practically offset the pressure wave in the pressure chamber after ejection of the ink. It is preferable to set this pulse width to be short such that the voltage applied to the piezoelectric actuator 2 does not change from one voltage to the other voltage. Accordingly, it is possible to avoid the length of the entire driving pulse signal being long. Consequently, it is possible to increase the drive frequency, and to increase the recording speed. Moreover, due to the pulse width becoming short, it is possible to suppress a fatigue and a heat generation in the piezoelectric actuator 2, and to perform a high quality recording operation stably over a long period of time.

The embodiment described above is an example in which the present invention is applied to an ink-droplet ejecting apparatus of an ink-jet type. However, embodiments to which the present invention is applicable are not restricted to the embodiment described above, and the present invention is also applicable to apparatuses used in various fields such as a medical treatment and analysis, without restricting to the ink-droplet ejecting apparatus.

What is claimed is:

1. An ink-droplet ejecting apparatus which ejects a plurality of ink droplets of an ink to form one dot onto a recording medium, comprising:

a pressure chamber in which the ink is filled;

an actuator which faces the pressure chamber, and which changes a volume of the pressure chamber, according to a driving pulse signal for ejecting the ink droplets to form one dot; and a signal control unit which supplies the driving pulse signal to the actuator;

wherein the driving pulse signal includes a plurality of main pulses which are successive with intervals to eject the ink droplets, and a stabilizing pulse which is inserted between the main pulses, and which suppresses a residual vibration of the ink, in the pressure chamber, generated by one of the main pulses applied before the stabilizing pulse; and a last main pulse, among the main pulses, is adjusted to suppress the residual vibration of the ink in the pressure chamber, generated by a main pulse applied before the last main pulse, and to prevent vibration generated by the last main pulse from remaining.

2. The ink-droplet ejecting apparatus according to claim 1, wherein the main pulses include a first main pulse, a second main pulse, and a third main pulse, and the stabilizing pulse is inserted between the first main pulse and the second main pulse.

3. The ink-droplet ejecting apparatus according to claim 2, wherein the second main pulse and the third main pulse have a short pulse width with respect to an one-way propagation time AL of a pressure wave generated due to the change in the volume of the pressure chamber.

4. The ink-droplet ejecting apparatus according to claim 2, wherein a pulse width Tm1 of the first main pulse, a pulse width Ts1 of the stabilizing pulse, a pulse width Tm2 of the second main pulse, a pulse width Tm3 of the third main pulse, an interval W1 between a tail end of the first main pulse and a lead end of the stabilizing pulse, an interval W2 between a tail end of the stabilizing pulse and a lead end of the second main pulse, and an interval W3 between a tail end of the second main pulse and a lead end of the third main pulse satisfy following relationships with respect to an one-way propagation time AL of a pressure wave generated due to the change in the volume of the pressure chamber:

$0.7\ AL \leqq Tm1 \leqq 1.3\ AL$, $0.8\ AL \leqq W1 \leqq 2.2\ AL$, $0.15\ AL \leqq Ts1 \leqq 0.4\ AL$, $0.8\ AL \leqq W2 \leqq 1.8\ AL$, $0.4\ AL \leqq Tm2 \leqq 0.8\ AL$, $0.8\ AL \leqq W3 \leqq 1.4\ AL$, and $0.5\ AL \leqq Tm3 \leqq 1.0\ AL$.

5. The ink-droplet ejecting apparatus according to claim 4, wherein the Tm1, the Ts1, the Tm2, the Tm3, the W1, the W2, and the W3 satisfy following relationships:

$0.9\ AL \leqq Tm1 \leqq 1.05\ AL$, $1.0\ AL \leqq W1 \leqq 2.0\ AL$, $0.2\ AL \leqq Ts1 \leqq 0.35\ AL$, $1.0\ AL \leqq W2 \leqq 1.5\ AL$, $0.5\ AL \leqq Tm2 \leqq 0.75\ AL$, $0.95\ AL \leqq W3 \leqq 1.1\ AL$, and $0.65\ AL \leqq Tm3 \leqq 0.8\ AL$.

6. The ink-droplet ejecting apparatus according to claim 2, wherein a pulse width Tm1 of the first main pulse, a pulse width Ts1 of the stabilizing pulse, a pulse width Tm2 of the second main pulse, a pulse width Tm3 of the third main pulse, an interval W1 between a tail end of the first main pulse and a lead end of the stabilizing pulse, an interval W2 between a tail end of the stabilizing pulse and a lead end of the second main pulse, and an interval W3 between a tail end of the second main pulse and a lead end of the third main pulse satisfy following relationships with respect to an one-way propagation time AL of a pressure wave generated due to the change in the volume of the pressure chamber:

$0.95\ AL \leqq Tm1 \leqq 1.25\ AL$, $1.0\ AL \leqq W1 \leqq 1.25\ AL$, $1.7\ AL \leqq Ts1 \leqq 1.88\ AL$, $0.87\ AL \leqq W2 \leqq 1.13\ AL$, $0.5\ AL \leqq Tm2 \leqq 0.88\ AL$, $1.12\ AL \leqq W3 \leqq 1.38\ AL$, and $0.75\ AL \leqq Tm3 \leqq 0.88\ AL$.

7. The ink-droplet ejecting apparatus according to claim 1, wherein a pulse width Ts1 of the stabilizing pulse with respect to an one-way propagation time AL of a pressure wave generated due to the change in the volume of the pressure chamber is $0.15\ AL \leqq Ts1 \leqq 0.40\ AL$.

8. The ink-droplet ejecting apparatus according to claim 7, wherein each of the main pulses has a pulse width sufficiently large for a voltage applied to the actuator to change from a voltage of one of two predetermined voltages, to be the other voltage of the two predetermined voltages; and the stabilizing pulse has a pulse width which is insufficient for the voltage to change from the one of the two predetermined voltage, to the other voltage of the two predetermined voltages.

9. The ink-droplet ejecting apparatus according to claim 1, wherein a pulse width Ts1 of the stabilizing pulse with respect to an one-way propagation time AL of a pressure wave generated by the change in the volume of the pressure chamber is $1.7\ AL \leqq Ts1 \leqq 1.8\ AL$.

10. The ink-droplet ejecting apparatus according to claim 1, wherein the volume of the pressure chamber is increased at lead ends of the stabilizing pulse and the main pulses applied to the actuator, and is decreased at tail ends of the stabilizing pulse and the main pulses applied to the actuator.

11. The ink-droplet ejecting apparatus according to claim 1, wherein the actuator is a piezoelectric element which is displaced with respect to the pressure chamber, by application of a voltage.

12. The ink-droplet ejecting apparatus according to claim 11, further comprising a signal control unit which supplies the driving pulse signal to the surface electrode.

13. The ink-droplet ejecting apparatus according to claim 1, wherein the signal control unit adjusts a pulse width of the stabilizing pulse such that the ink droplets are not ejected.

14. The ink-droplet ejecting apparatus according to claim 1, wherein the signal control unit adjusts a pulse width of the stabilizing pulse to be shorter than a pulse width of each of the main pulses.

* * * * *

UNITED STATES PATENT AND TRADEMARK OFFICE

CERTIFICATE OF CORRECTION

PATENT NO. : 7,891,750 B2
APPLICATION NO. : 11/698385
DATED : February 22, 2011
INVENTOR(S) : Akira Iriguchi It is certified that error appears in the above-identified patent and that said Letters Patent is hereby corrected as shown below:

Claim 12:

Please Cancel Claim 13 which is maintained as Claim 12 in the Letter Patent.

Original Claim 12 was erroneously canceled; Claim 12 should read as follows:

-- The ink-droplet ejecting apparatus according to claim 1, wherein the actuator further includes a surface electrode to which the driving pulse signal is applied. --

Signed and Sealed this
Twenty-ninth Day of November, 2011

David J. Kappos

David J. Kappos
*Director of the United States Patent and Trademark Office*